US005842080A

United States Patent [19]

Ashibe et al.

[11] Patent Number: 5,842,080

[45] Date of Patent: Nov. 24, 1998

[54] IMAGE FORMING APPARATUS AND INTERMEDIATE TRANSFER MEMBER

[75] Inventors: Tsunenori Ashibe, Yokohama; Hiroyuki Kobayashi, Fuji; Akihiko Nakazawa, Shiroyamamachi; Atsushi Tanaka, Yokohama; Takashi Kusaba, Kawasaki, all of Japan

[73] Assignee: Canon Kabushiki Kaisha, Tokyo, Japan

[21] Appl. No.: 813,678

[22] Filed: Mar. 7, 1997

Related U.S. Application Data

[63] Continuation of Ser. No. 637,454, Apr. 25, 1996, abandoned.

[30] Foreign Application Priority Data

Apr. 26, 1995 [JP] Japan ..... 7-102378

[51] Int. Cl.[6] ..... G03G 15/00; G03G 15/01; G03G 15/16

[52] U.S. Cl. ..... 399/49; 399/302

[58] Field of Search ..... 399/39, 40, 41, 399/49, 302

[56] References Cited

U.S. PATENT DOCUMENTS

| | | | |
|---|---|---|---|
| 4,312,589 | 1/1982 | Brannan et al. | 355/14 CH |
| 5,103,260 | 4/1992 | Tompkins et al. | 355/208 |
| 5,258,783 | 11/1993 | Sasanuma et al. | 346/157 |
| 5,258,811 | 11/1993 | Miyake et al. | 355/210 |
| 5,296,903 | 3/1994 | Suzuki et al. | 355/271 |
| 5,438,398 | 8/1995 | Tanigawa et al. | 355/271 |
| 5,512,986 | 4/1996 | Toyomura et al. | 355/246 |
| 5,625,857 | 4/1997 | Shimada et al. | 399/49 |

FOREIGN PATENT DOCUMENTS

| | | |
|---|---|---|
| 0604941 | 7/1994 | European Pat. Off. . |
| 59-013264 | 1/1984 | Japan . |
| 63-301960 | 12/1988 | Japan . |
| 4-18310[B] | 3/1992 | Japan . |
| 5-53402 | 3/1993 | Japan . |
| 05333725 | 12/1993 | Japan . |

*Primary Examiner*—Joan H. Pendegrass
*Attorney, Agent, or Firm*—Fitzpatrick, Cella, Harper & Scinto

[57] ABSTRACT

An image forming apparatus includes: a first image-bearing member, an intermediate transfer member for receiving an image formed on the first image-bearing member and transferring the image onto a second image-bearing member, pattern-forming means for forming a prescribed pattern on the intermediate transfer member, density detection means for detecting a density of the pattern, and control means for controlling image forming conditions based on the detected density. The intermediate transfer member is set to have a reflectance of 10–70% for light having a wavelength in the range of 700–1500 nm at least in a region thereof for forming the prescribed pattern. As a result, the pattern density detection is suitably performed on the intermediate transfer member for all of yellow, magenta cyan and black, and the detected density data is used for controlling the image forming conditions.

16 Claims, 13 Drawing Sheets

IMAGE FORMING APPARATUS AND INTERMEDIATE TRANSFER MEMBER

This application is a continuation of application Ser. No. 08/637,454 filed Apr. 25, 1996, now abandoned.

FIELD OF THE INVENTION AND RELATED ART

The present invention relates to an image forming apparatus, and particularly an image forming apparatus, such as a copying machine, a printer or a facsimile apparatus, of a type wherein an image formed on a first image-bearing member is first transferred to an intermediate transfer member (primary transfer), and then further transferred to a second image-bearing member (secondary transfer). The present invention further relates to an intermediate transfer member used in such an image forming apparatus.

The above-mentioned type of image forming apparatus using an intermediate transfer member is effective as a multi-color image forming apparatus for synthetically reproducing a multi-color image product by sequentially transferring a plurality of component color images in superposition based on multi-color image data, whereby a multi-color image free from deviation (color deviation) among the respective component color images is produced.

FIG. 1 shows an outline of an example of an image forming apparatus using a drum-shaped intermediate transfer member.

The image forming apparatus shown in FIG. 1 is a full-color image forming apparatus (copying machine or laser beam printer) using an electrophotographic process and including an elastic roller 20 of a medium resistivity as an intermediate transfer member.

The image forming apparatus further includes a rotating drum-type electrophotographic photosensitive member (hereinafter simply called "photosensitive member") repetitively used as a first image-bearing member, which is driven in rotation in an arrow direction at a prescribed peripheral speed (process speed).

During rotation, the photosensitive member 1 is uniformly charged to a prescribed potential of a prescribed polarity by a primary charger (corona discharger) 2 and then receives imagewise exposure light from an imagewise exposure means (not shown) (such as a color separation-focusing exposure optical system for a color original image, or a scanning exposure optical system including a laser scanner for outputting a laser beam modulated accordance with time-serial electrical digital image signals based on image data). As a result, an electrostatic latent image corresponding to a first color component image (e.g., a magenta component image) to an objective color image is formed on the photosensitive member 1.

Then, the electrostatic latent image is developed into a magenta component image (as a first color component image) by a first developing device (magenta developing device). At this time, second to fourth developing devices, i.e., a cyan developing device 42, a yellow developing device 43 and a black developing device 44, are not operated, and thus are not acting on the photosensitive member 1, so that the first color magenta component image is not affected by the second to fourth developing devices 42–44.

An intermediate transfer member 20 includes a cylindrical support member 21 and an elastic layer 22 formed around the outer periphery thereof, and driven driver in rotation in an indicated arrow direction at a peripheral speed identical to that of the photosensitive member 1.

The first color magenta component image formed on the photosensitive member 1 is sequentially primary-transferred to the outer periphery of the intermediate transfer member 20 while it passes through a nip between the photosensitive member 1 and the intermediate transfer member 20 under the action of an electric field formed by a primary transfer bias (voltage) applied to the intermediate transfer member 20.

The surface of the photosensitive member 1 after transfer of the first color magenta toner image is cleaned by a cleaning device 14.

Thereafter, in similar manner, a second color cyan component image, a third color yellow component image and a fourth color black component image are sequentially transferred in superposition onto the intermediate transfer member 20 to form a full color image corresponding to an objective color image thereon.

The transfer bias for sequentially transferring the first to fourth color toner images from the photosensitive member 1 in superposition onto the intermediate transfer member 20 is of a polarity opposite to that of the toner and is applied from a bias supply 61. The applied voltage therefor is, e.g., in the range of +2 to +5 kV (or −2 to −5 kV).

The image forming apparatus further includes a transfer roller 25, which is supported on a shaft in parallel with the intermediate transfer member 20 so as to contact the lower surface thereof. However, the transfer roller 25 and an intermediate transfer member cleaner 35 (described later) can be separably disposed from the intermediate transfer member 20 during the steps for transferring the first to fourth color toner images from the photosensitive member 1 to the intermediate transfer member 20.

The full-color toner image superposedly transferred onto the intermediate transfer member 20 is secondary-transferred to a transfer(-receiving) material (second image-bearing member) 24 by causing the transfer roller 25 to abut against the intermediate transfer member 20, supplying the transfer material 24 from a paper supply cassette 9 to the abutting position between the intermediate transfer member 20 and the transfer roller 25 at prescribed time and simultaneously by applying a secondary transfer bias to the transfer roller 25. The transfer material 24 bearing the transferred toner image is then introduced to a fixing device 15 for hot fixing of the toner image.

After completion of the image transfer onto the transfer material 24, a transfer residual toner on the intermediate transfer member 20 is cleaned by an intermediate transfer member cleaner 35 abutting against the intermediate transfer member 20.

The above-mentioned image forming apparatus using an intermediate transfer member is advantageous over an image forming apparatus wherein images are transferred from a first image-bearing member onto a second image-bearing member attached onto or attracted by a transfer drum (e.g., as disclosed in Japanese Laid-Open Patent Application (JP-A) 63-301960) in the following respects:

(a) Little color deviation occurs during superposition of respective color image.

(b) As is understood from FIG. 1, no means is required for processing or controlling the second image-bearing member (e.g., gripping by a gripper, attracting, providing a curvature, etc.), so that a wide variety of second image-bearing members can be used. For example, it is possible to use from a thin paper of ca. 40 g/m$^2$ to a thick paper of ca. 200 g/m$^2$ equally as a second image-bearing member. Further, the transfer can be performed regardless of a difference in width and/or length of the second image-bearing member, so that it is applicable to even an envelop, a post-card or a label paper.

Because of such advantages accompanying the use of an intermediate transfer member, the type of image forming apparatus using an intermediate transfer member has become commercially available as a color copying machine or a color printer.

On the other hand, an electrophotographic image forming apparatus has been known to involve a difficulty in that its performance are liable to change under different conditions of use or on continuation of use. This may be attributable to, for example, a change in humidity, a deterioration of a photoconductive material constituting the photosensitive member, an abrasion of the photosensitive member by the cleaning means, and a change in the ability to triboelectrically charge the developer.

In the case of a full-color image forming apparatus using no intermediate transfer member, there has been known a technique of forming a characteristic pattern on an electrophotographic photosensitive member, etc., detecting a density of the pattern and feeding the detected data back for adjusting the toner replenishing quantity and the image forming conditions, such as a developing bias (voltage), to stabilize the image quality.

More specifically, FIG. 2 shows an outline of an example of a full-color image forming apparatus P using no intermediate transfer member. Laser light emitted from a laser (not shown) generate based on image signals is reflected by a rotating polygonal mirror 201 and a mirror 202 to be incident on a primarily charged photosensitive member 204. The photosensitive member 204 rotates in an indicated arrow direction during which time the photosensitive member is exposed to the scanning laser light in the above-described manner to form an electrostatic latent image sequentially thereon. The thus-formed electrostatic latent image is developed by a rotating developing device 203, and the developed toner image is then transferred onto a transfer (-receiving) paper 206 wound about a transfer drum 205. These steps are repeated in for a total of four cycles, sequentially for Y (yellow), M (magenta), C (cyan) and BK (black), respectively, to form a full color image.

After completion of the transfer, the transfer paper 206 is separated from the transfer drum 205, and subjected to fixing by a pair of fixing rollers 207 to form a full-color image print.

The above-mentioned pattern formed for controlling the image forming conditions is also obtained in the above-described manner. An LED 208 issuing near infrared rays (having a principal wavelength at ca. 950 nm) is used as an illumination means for illuminating the photosensitive member, and reflected light from the photosensitive member is read by a sensor 209.

Based on the thus-obtained pattern density data, the image forming conditions may be controlled according to methods, e.g., as disclosed in U.S. Pat. Nos. 4,312,589, 5,258,783 and 5,296,903, and JP-A 5-53402, thereby obtaining best full color images under the respective conditions.

As described above, in the case of a color electrophotographic image forming apparatus using no intermediate transfer member, it has become possible to adjust suitable image forming conditions by using a density detection device as described above. In the case of using a color electrophotographic image forming apparatus using an intermediate transfer member, it is desirable to effect a density measurement as described above on the intermediate transfer member in order to obtain more accurate density data.

There has been known a color electrophotographic image forming apparatus using an intermediate transfer member wherein the toner amount detection is performed on the intermediate transfer member (Japanese Patent Publication (JP-B) 4-18310). However, in the apparatus, the toner amounts transferred onto the intermediate transfer member are measured with respect to three toners of yellow, magenta and cyan and not with respect to a black toner desirable to provide clearer full color images, and moreover the toner amount detection is performed with respect to transmitted light through a sheet constituting the intermediate transfer member.

However, in view of the required functions of an intermediate transfer member, such as an accurate toner image transfer and a frequent contact with the first and second image-bearing members, the intermediate transfer member is required to have a preferred level of resistivity ($1\times10^{4-1\times10^{13}}$ ohm.cm) and a high mechanical strength. For this reason, the intermediate transfer member generally requires the inclusion of a large amount of filler, such as carbon black. The resultant intermediate transfer member becomes opaque and provides a lower reflectance to light, thus making difficult an accurate density measurement of a pattern formed thereon especially with respect to a black toner pattern.

SUMMARY OF THE INVENTION

An object of the present invention is to provide an image forming apparatus allowing a better accuracy of pattern density measurement for controlling image forming conditions and capable of providing best images under available conditions.

Another object of the present invention is to provide an image forming apparatus allowing a broader latitude for pattern density measurement designing.

A further object of the present invention is to provide an intermediate transfer member suitable for use in an image forming apparatus as described above.

According to the present invention, there is provided an image forming apparatus, comprising:

a first image-bearing member, an intermediate transfer member for receiving an image formed on the first image-bearing member and transferring the image onto a second image-bearing member, pattern-forming means for forming a prescribed pattern on the intermediate transfer member, density detection means for detecting a density of the pattern, and control means for controlling image forming conditions based on the detected density, wherein the intermediate transfer member has a reflectance of 10–70% for light having a wavelength in the range of 700–1500 nm at least in a region thereof for forming the prescribed pattern.

According to another aspect of the present invention, there is provided an intermediate transfer member having the above-mentioned reflectance characteristic for use in an image forming apparatus as described above.

In the present invention, a large reflectance difference between a black toner (reflectance on the order of below 10%) and other color toners (reflectance on the order of 80% or higher) is utilized, and the reflectance of the intermediate transfer member is adjusted to an intermediate level between the two levels to provide a good contrast with both a black toner pattern and other color toner patterns, instead of providing different reflectance regions for different color toners.

These and other objects, features and advantages of the present invention will become more apparent upon a consideration of the following description of the preferred embodiments of the present invention taken in conjunction with the accompanying drawings.

DETAILED DESCRIPTION OF THE INVENTION

The image forming apparatus according to the present invention basically includes a first image-bearing member, and an intermediate transfer member for receiving an image formed on the first image-bearing member and transferring the image onto a second image-bearing member. The image forming apparatus further includes pattern-forming means for forming a prescribed pattern on the intermediate transfer member, density detection means for detecting a density of the pattern, and control means for controlling image forming conditions based on the detected density. Further, the intermediate transfer member is designed to have a reflectance of 10–70% for light having a wavelength in the range of 700–1500 nm at least in a region thereof for forming the prescribed pattern.

Figure 3:
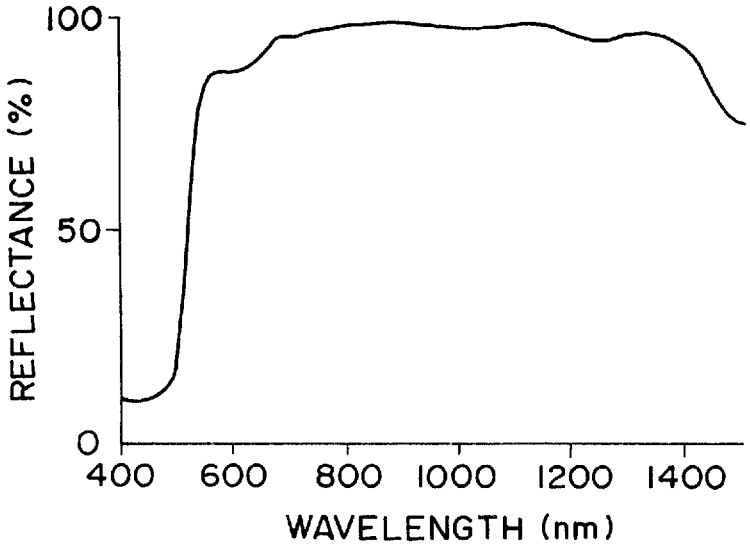
FIGS. 3–6 are graphs showing spectral reflectance characteristics of yellow toner, magenta toner, cyan toner and black toner, respectively.
Figure 4:
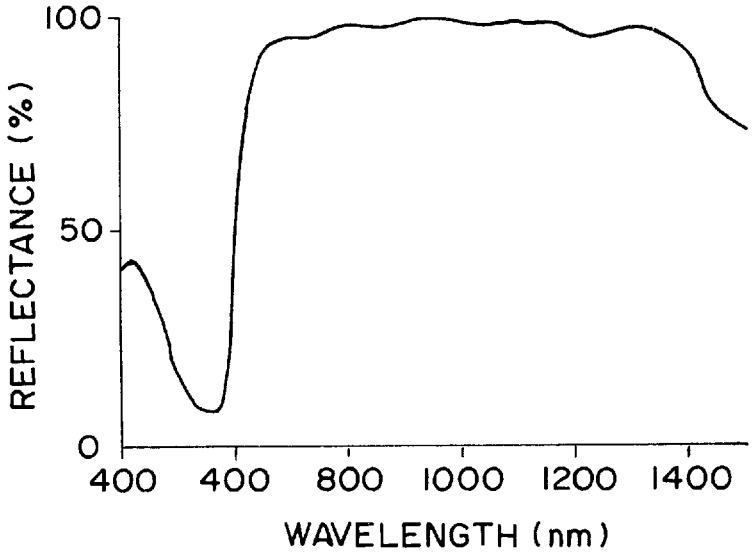
Figure 5:
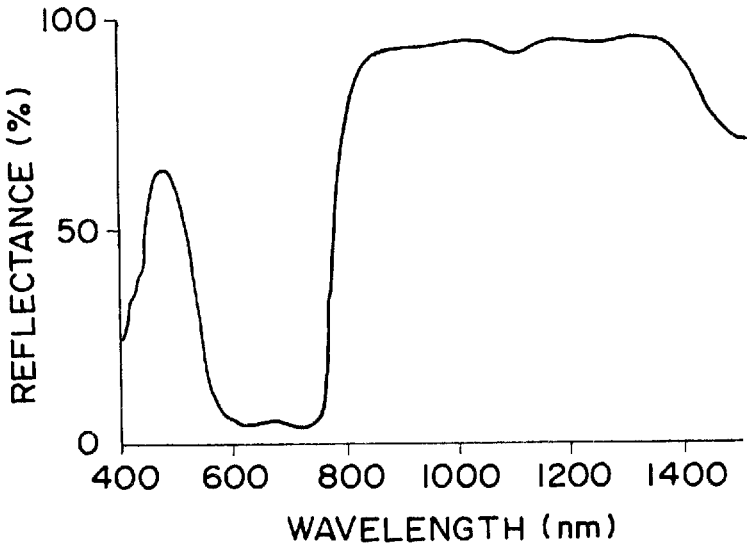

Ordinarily, yellow, magenta and cyan toners have spectral reflectance characteristic as shown in FIGS. 3–5, respectively, and show reflectance of at least 80% for light having a wavelength in the range of 700–1500 nm.

Figure 6:
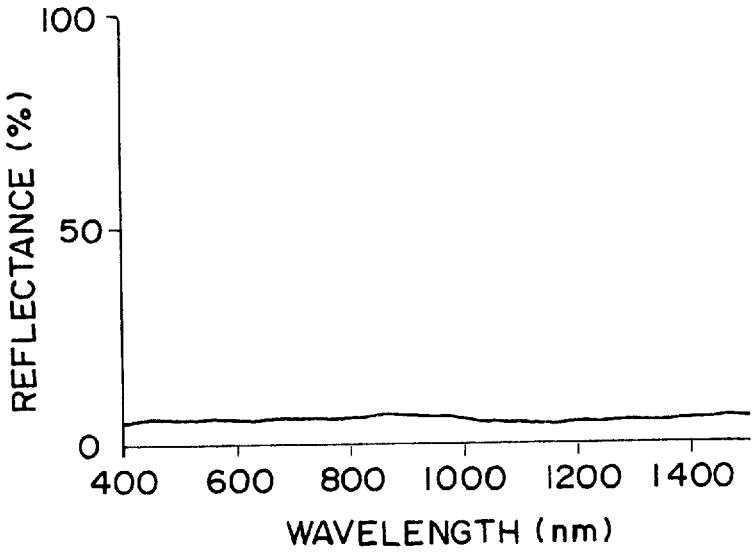

On the other hand, a black toner (e.g., a mono-component magnetic toner) has a spectral reflectance characteristic as shown in FIG. 6 showing a reflectance of at most ca. 10% for light having a wavelength in the range of 700–1500 nm.

In the present invention, based on the above facts and the aforementioned concept of the present invention, the intermediate transfer member is designed to have a reflectance of 10–70%, preferably 15–60%, further preferably 15–35%, at least in a pattern density-detection region thereof for light having a wavelength in the range of 700–1500 nm, e.g., at a near infrared wavelength of ca. 950 nm, thereby allowing the density detection of all of black and color images at an improved accuracy.

Figure 7:
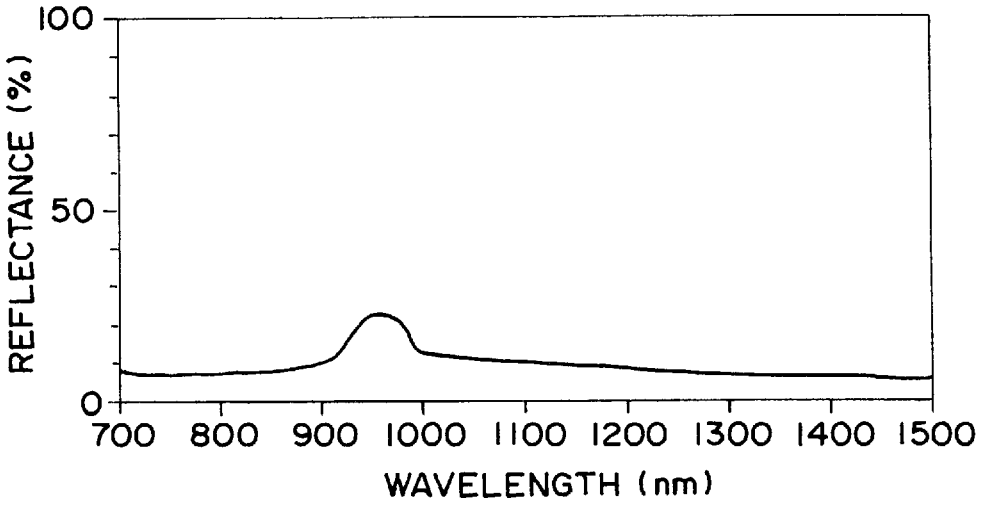
FIGS. 7–9 are graphs each showing a spectral reflectance characteristic of an intermediate transfer member suitable for use in the invention.

The intermediate transfer member need not show an overall reflectance of 10–70% for light having wavelengths ranging from 700 to 1500 nm. It is sufficient if the intermediate transfer member shows a spectral reflectance of 10–70% for a light fraction having a specific wavelength in the range of 700–1500 nm even if the intermediate transfer member shows a spectral reflectance of below 10% (or above 70%) at another wavelength in the same range as shown in FIG. 7 (showing a spectral reflectance of ca. 23% at 950 nm). In such a case, a stable and accurate image density is still possible by using a detection means including a light source issuing infrared rays having a principal or peak wavelength at or near the specific wavelength.

Figure 8:
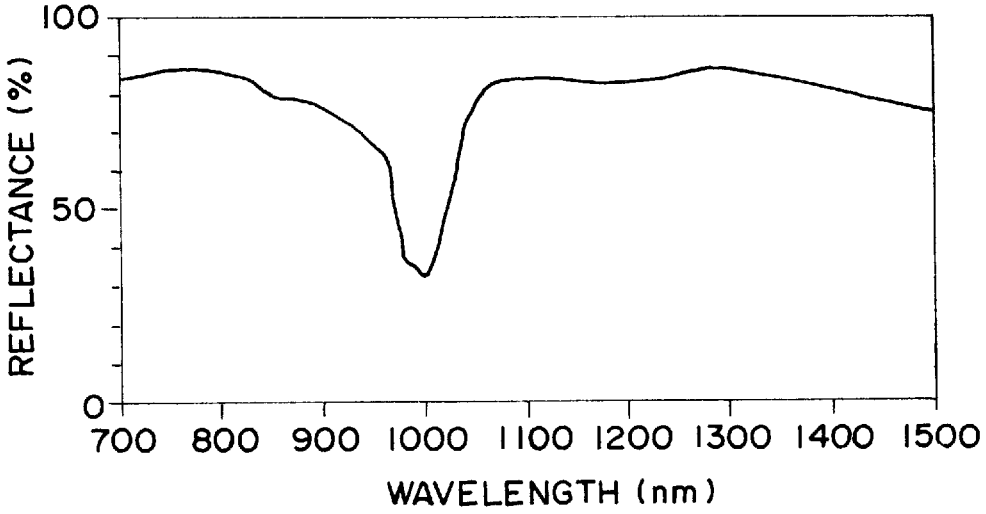
Figure 9:
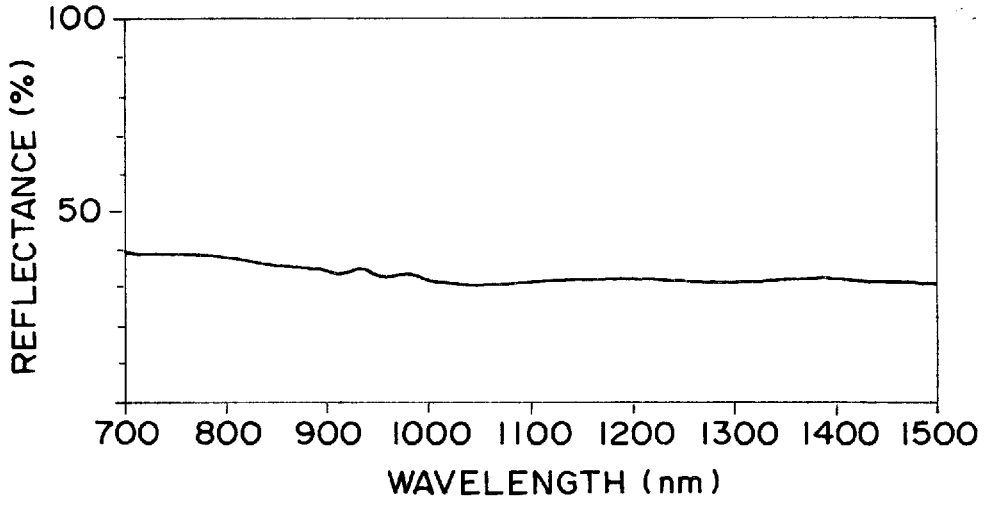
Figure 10:
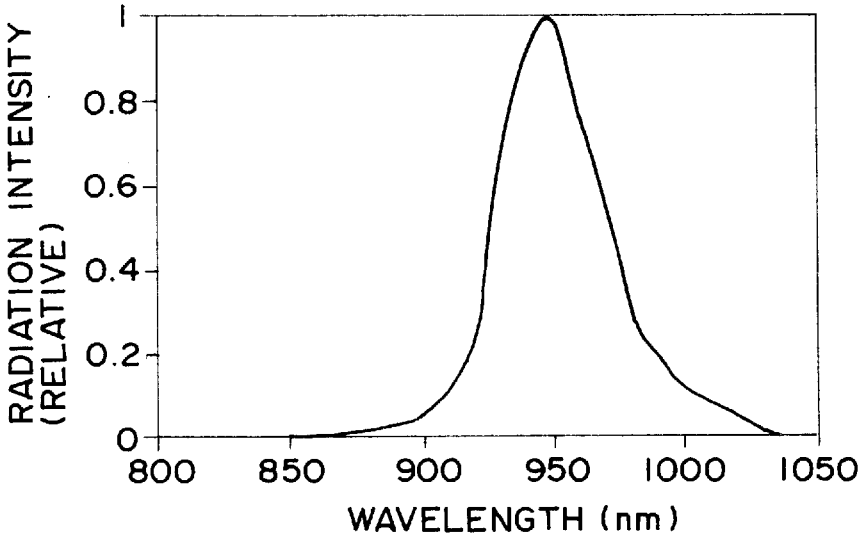
FIG. 10 is a graph showing a spectral radiation intensity characteristic of light used for image density measurement.

On the other hand, an intermediate transfer member showing a spectral reflectance exceeding 70% at some wavelength can also be used if it also shows a spectral reflectance in the range of 10–70% at a specific wavelength in the range of 700–1500 nm as shown in FIG. 8 (showing a spectral reflectance of ca. 33% at 1000 nm). In this case, a stable and accurate density detection is also possible by using a photodetection system using infrared rays having a principal wavelength at or near the specific wavelength (1000 nm).

It is of course possible to use an intermediate transfer member showing a reflectance of 10–70% average in the wavelength range of 700–1500 nm for effecting a stable and accurate density detection by using infrared rays having a principal wavelength in the range.

In the present invention, the light used for the density detection should have a principal wavelength in the range of 700–1500 nm as a matter of course but may preferably have a principal wavelength in the range of 800–1100 nm, particularly 900–1000 nm, in view of the stability of reflectance for the color toners.

It is not always necessary that the optimum wavelength for the density detection and the principal wavelength of light actually be used. This is because light having a principal wavelength at a specific wavelength, of, e.g., 950 nm, has a region showing a relative radiation intensity of ca. 0.6–0.8 near the principal wavelength, so that the density detection can be effected also in the region.

The reflectances of toners and intermediate transfer members referred to herein are based on values measured by using a commercially available apparatus ("U-3400", available from Hitachi Seisakusho K. K.) equipped with a large sample chamber integrating sphere at scanning speeds of 300 nm/min for the visible region and 600 nm/min for the infrared region, a response level of medium, and band passes of 5.00 nm for the visible region and servo (variable) for the infrared region.

Figure 11:
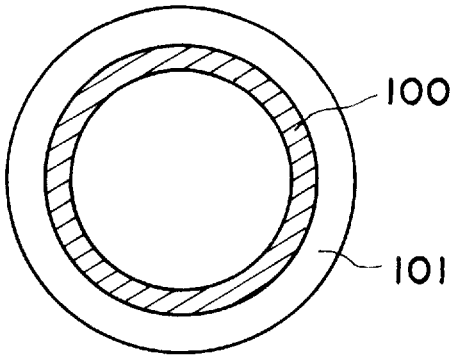
FIGS. 11 and 12 are respective a diametrical sectional views of drum-shaped intermediate transfer members used in the invention.
Figure 12:
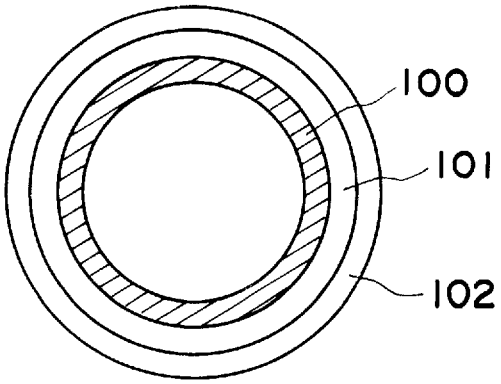
Figure 13:
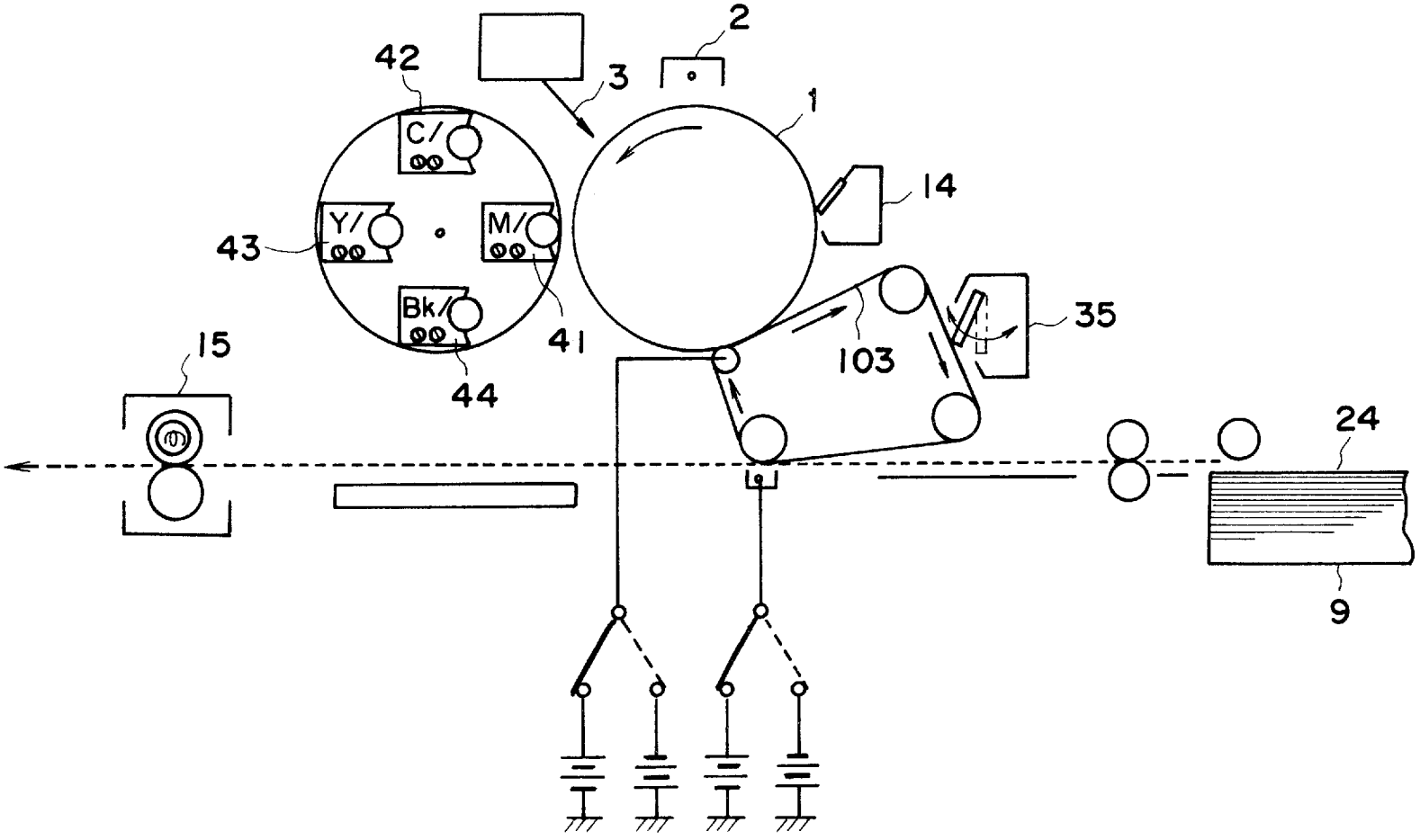
FIG. 13 is an illustration of an image forming apparatus including an intermediate transfer member in the form of an endless belt.

The intermediate transfer member used in the present invention may have a structure including at least an electroconductive support and an elastic layer thereon comprising rubber, elastomer or resin, optionally further one or more coating layers thereon. The intermediate transfer member may have various shapes including drums or rollers as shown in FIGS. 11 and 12 and an endless belt (103) as shown in FIG. 13, which may be arbitrarily selected depending on the purpose or necessity. FIGS. 11 and 12 show drum-shaped intermediate transfer members including a cylindrical electroconductive support 100 and an elastic layer 101, and further a coating layer 102. The endless belt-shaped intermediate transfer member 103 (FIG. 13) may also have a similar lamination structure although the outer shape is different. In the present invention, the intermediate transfer member may preferably be in the form of a drum or roller in view of little color deviation in superposition of colors and durability in repetitive use.

The electroconductive support (100) may preferably comprise a metal or alloy, such as aluminum, iron, copper or stainless steel, or an electroconductive resin containing eletroconductive carbon or metal particles. The support may have the shape of a drum or an endless belt as described above, inclusive of a drum equipped with a shaft piercing therethrough and a cylindrical bar.

The elastic layer (101) and the coating layer (102) of the intermediate transfer member used in the present invention may comprise a rubber or elastomer, or a resin. Examples of the rubber or elastomer may include: styrene-butadiene rubber, high-styrene rubber, butadiene rubber, isoprene rubber, ethylene-propylene copolymer, nitrile-butadiene rubber, chloroprene rubber, butyl rubber, silicone rubber, fluorine-containing rubber, nitrile rubber, urethane rubber, acrylic rubber, epichlorohydrin rubber, and norbornene rubber. Examples of the resin may include: styrene-based resins (homopolymers and copolymers of styrene and substituted styrene, inclusive of polystyrene, chloropolystyrene, poly-α-methylstyrene, styrene-butadiene copolymer, styrene-vinyl chloride copolymer, styrene-vinyl acetate copolymer, styrene-maleic acid copolymer), styrene-acrylate copolymers (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (such as styrene-methyl methacrylate copolymer, styrene-ethyl methacrylate copolymer and styrene-phenyl methacrylate copolymer), styrene-methyl α-chloroacrylate copolymer, and styrene-acrylonitrile-acrylate copolymers; vinyl chloride resin, styrene-vinyl acetate copolymer, rosin-modified maleic acid resin, phenolic resin, polyester resin, low-molecular weight polyethylene, low-molecular weight polypropylene, ionomer resins, polyurethane resin, silicone resin, ketone resin, ethylene-ethyl acrylate copolymer, xylene resin, and polyvinyl butyral resin. These rubbers or elastomers, and resins can also be used in combination of two or more species.

The intermediate transfer member may preferably have a resistivity on the order of $1\times10^{4-1\times103}$ ohm.cm. For this purpose, the elastic layer or the coating layer may contain an electroconductive substance dispersed therein or comprise an electroconductive resin.

Examples of the electroconductive substance may include: electroconductive carbon black; and electroconductive materials inclusive of metals such as aluminum and nickel; electroconductive metal oxides, such as electroconductive titanium oxide, electroconductive tin oxide, electroconductive zinc oxide and electroconductive zinc oxide and electroconductive indium oxide; and electroconductive polymeric compounds, such as quaternary ammonium salt-containing polymethyl methacrylate, polyvinylaniline, polyvinylpyrrole, polydiacetylene, polyethyleneimine, boron-containing polymers and polypyrrole. These may be used singly or in combination of two or more species. These are however not exhaustive.

In the case of forming the surface layer(s) of the intermediate transfer member without using an electroconductive filter, the resultant intermediate transfer member is liable to have an excessively high transmittance so that it becomes also difficult to provide a sufficient density contrast with yellow toner, magenta toner and cyan toner having a high resistance. In this case, it is also effective to positively lower the reflectance of the intermediate transfer member according to the present invention.

The intermediate transfer member may preferably contain a lubricating agent in its surface layer so as to exhibit an improved releasability.

Examples of lubricating substances (sometimes in the form of particles) may include: tetrafluoroethylene resin, trifluorochloroethylene resin, tetrafluoroethylene-hexafluoropropylene copolymer resin, vinyl fluoride resin, vinylidene fluoride resin, difluorodichloro-ethylene resin, fluorinated carbon, silicone resin, silicone rubber, silicone elastomer, polyethylene (PE), polypropylene (PP), polystyrene (PS), acrylic resin, nylon resin, phenolic resin, epoxy resin, silica, and alumina. These may be used singly or in combination of two or more species. Among these, tetrafluoroethylene resin and tetrafluoroethylene-hexafluoropropylene copolymer resins are particularly preferred.

The elastic layer (101) may preferably have a thickness of at least 0.5 mm, more preferably at least 1 mm, further preferably 1–10 mm. On the other hand, the coating layer (102) may preferably be thin so as to conduct the softness of the lower elastic layer to the surface of the intermediate transfer member and more specifically have a thickness of at most 3 mm, more preferably at most 2 mm, further preferably 20 μm–1 mm.

The intermediate transfer member may be set to have a reflectance in the above-mentioned specific range by incorporating a reflectance-adjusting pigment into the coating layer and/or the elastic layer, and/or controlling the thickness of the coating layer.

Examples of the reflectance-adjusting pigment incorporated in the coating layer and/or the elastic layer may include; white pigments, such as titanium oxide (such as titanium white), barium sulfate, and zinc white; value pigments, such as phthalocyanine blue; red pigments, such as dimethylquinacridone, yellow pigments, such as disazo yellow, and black pigments, such as a relatively small amount of carbon black. Among these, white pigments are preferred because of coloring ability, and titanium white is particularly preferred because of coloring ability and dispersibility.

The pigment may preferably be contained in a proportion of 0.2–10 wt. parts, particularly 1–3 wt. parts, per 100 wt. parts of the elastomer and the resin in the layer in which the pigment is contained. In the use of a black pigment, the pigment may preferably be contained in a proportion of 0.05–0.5 wt. part per 100 wt. parts of the elastomer and the resin in the layer concerned.

In case of the thickness adjustment method, the coating layer thickness may preferably be adjusted in the range of at most 3 μm, more preferably at most 2 mm, further preferably 0.02 μm–1 mm.

Among the above-mentioned reflectance adjustment methods, it is preferred to adopt the method of incorporating a pigment in a layer, which may preferably be not the uppermost surface layer but an intermediate layer so as to retain the required properties, such as strength, releasability, water-repellency and electroconductivity, of the surface layer of the intermediate transfer member functioning to directly receive an image transferred thereto and transferring the received imaged to a second image-bearing member, unlike the transfer drum. Thus, it is preferred to control the reflectance by including the pigment in an intermediate layer so as to leave a broad latitude of designing to the surface layer.

Further, as it is undesirable for a photosensitive layer to contain a colorant affecting the electrophotographic performance, the present invention controlling the reflectance of the intermediate transfer member is also effective in providing a broader latitude of designing to the photosensitive member, in addition to the provision of more accurate density data.

The present invention does not require a special light source or a sensor with an extremely high accuracy compared with a system using an intermediate transfer member having a reflectance not satisfying the requirement of the present invention. Also, in this respect, a broad latitude of designing is provided.

Figure 14:
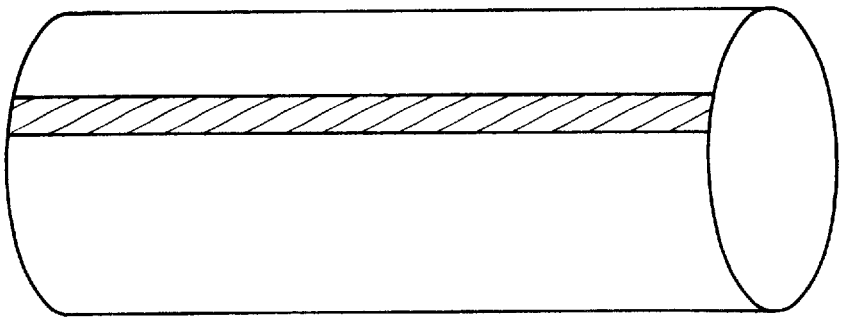
FIGS. 14–16 are perspective illustrations of drum-shaped intermediate transfer members usable in the invention having specified reflectance portions in the form of a longitudinal stripe, a circumferential stripe and a square, respectively.
Figure 15:
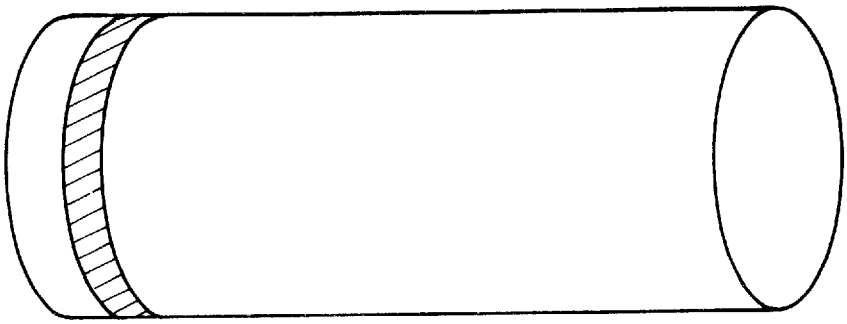
Figure 16:
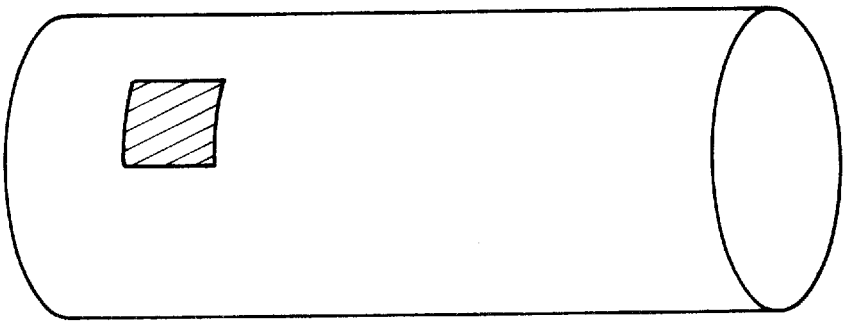

In the present invention, the intermediate transfer member need not have the specific resistance over the entire surface thereof but it is sufficient that the intermediate transfer member has a surface region at least locally showing the specific reflectance where the pattern density is measured. For example, the intermediate transfer member may have a longitudinal stripe region (as shown in FIG. 14), a circumferential stripe region (as shown in FIG. 15) or a local pattern of, e.g., a square (as shown in FIG. 16) showing the specific reflectance. However, in view of the convenience of production and so as not to result in locally different properties, the intermediate transfer member may preferably have the specific reflectance over the entire surface.

In the present invention, the density measurement pattern-forming method, the shape of the pattern, the pattern density-measurement means, the control means for controlling image forming conditions based on the detected pattern density, the timing of the control, etc., need not be particularly limited, but may be selected according to known techniques.

For example, the pattern may include a succession of square images having several density levels, which may be provided for the respective colors. The optical system for density detection may for example include a light source of, e.g., an LED emitting light having a principal wavelength around 950 nm, and a sensor made of, e.g., a silicon photo-diode. Based on the detected pattern density, it may be possible to control, e.g., the developing bias, the spot diameter of exposure light for exposing the first image-bearing member, and the quantity of replenished toner.

The first image-bearing member used in the present invention may suitably comprise an electrophotographic photosensitive member, of which the structure and composition need not be particularly limited.

The second image-bearing member used in the present invention may include various types of paper and OHP sheets.

Hereinbelow, the present invention will be described more specifically based on Examples and Comparative Examples.

EXAMPLE 1

Elastic Layer Compound 100 wt. parts of EPDM (ethylene-propylene-diene copolymer rubber), 5 wt. parts of zinc oxide, 1 wt. part of higher fatty acid, 5 wt. parts of electroconductive carbon, 10 wt. parts of paraffin oil, 2 wt. parts of sulfur, and totally 4 wt. parts of vulcanization promoters (1 wt. part of 2-mercaptobenzothiazole (MBT), 1.5 wt. parts of tetramethylthiuram disulfide (TMTD) and 1.5 wt. parts of zinc dimethyldithiocarbamate (ZnMDD)) were blended by a two roll mill under cooling for 20 min. to prepare a compound.

Surface Layer Paint 50 wt. parts of polyurethane prepolymer, 3 wt. parts of titanium white (colorant), 40 wt. parts of electroconductive titanium oxide, 5 wt. parts of dispersion aid, 100 wt. parts of toluene, 50 wt. parts of curing agent and 100 wt. parts of PTFE (polytetrafluoroethylene) particles, were blended and dispersed for 30 min. in a beads mill to prepare a surface layer paint.

Preparation and Evaluation of Intermediate Transfer Member

On an aluminum cylinder (outer diameter=182 mm, length=320 mm, thickness=5 mm), the elastic layer compound was transfer-molded and vulcanized to form a 5 mm-thick elastic layer, which was then coated with the surface layer paint by spray coating to form a 40 $\mu$m-thick surface layer, thereby obtaining an intermediate transfer member.

Figure 17:
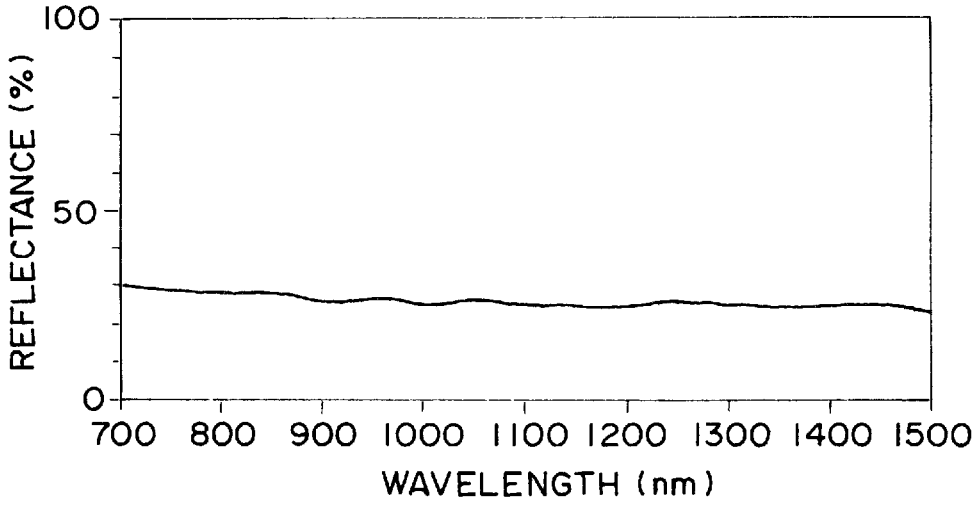
FIGS. 17–20 are graphs showing spectral reflectance characteristic of intermediate transfer members prepared in Example 1, Example 2, Comparative Example 1 and Comparative Example 2, respectively.

The reflectance of the thus-obtained intermediate transfer member was measured according to the above-described manner to obtain a spectral reflectance characteristic as shown in FIG. 17.

Figure 1:
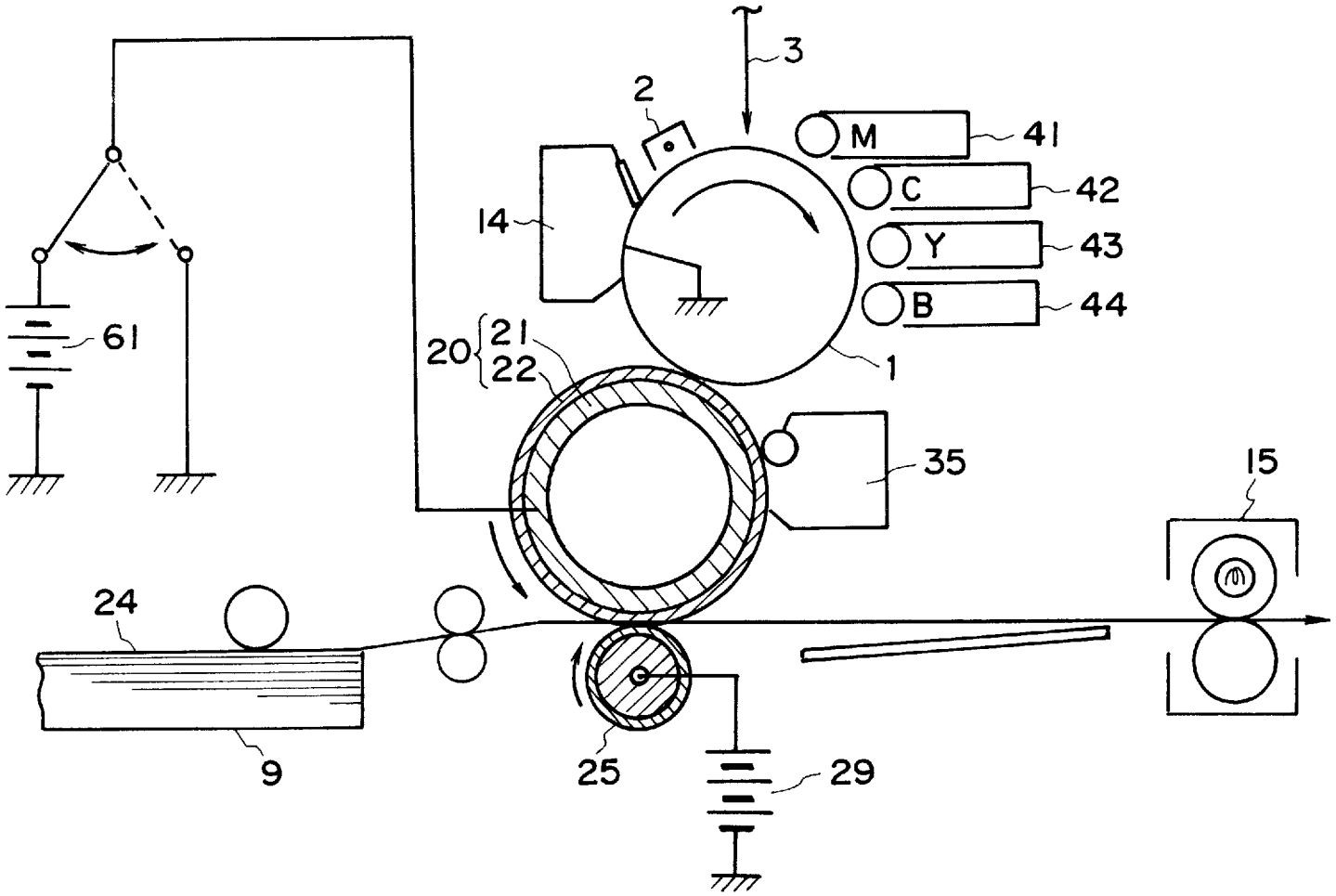
FIG. 1 is an illustration of an image forming apparatus including an intermediate transfer member.
Figure 2:
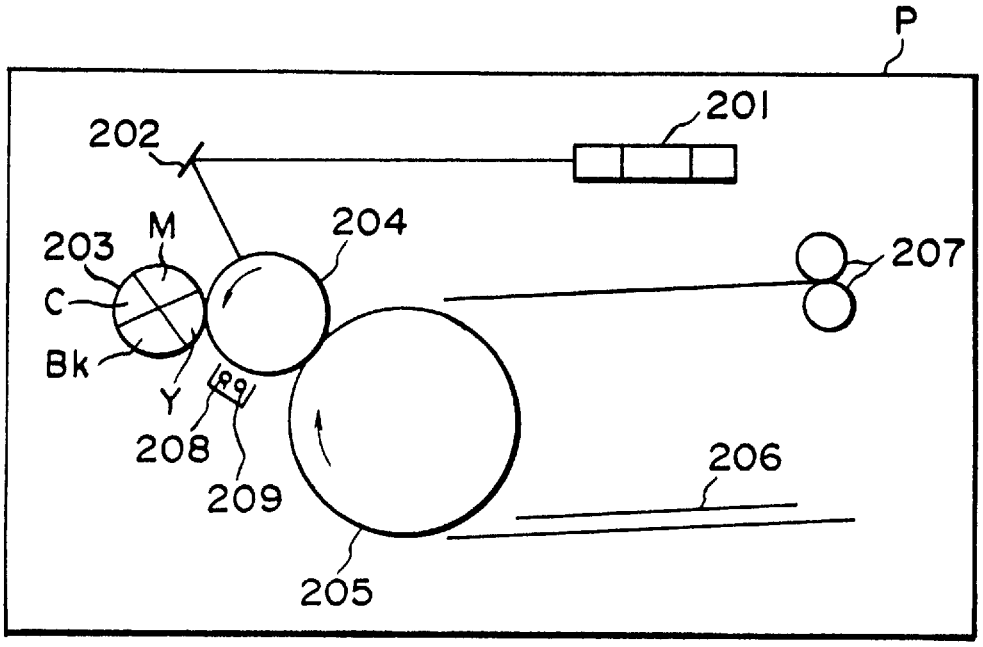
FIG. 2 is an illustration of an image forming apparatus including no intermediate transfer member.
Figure 21:
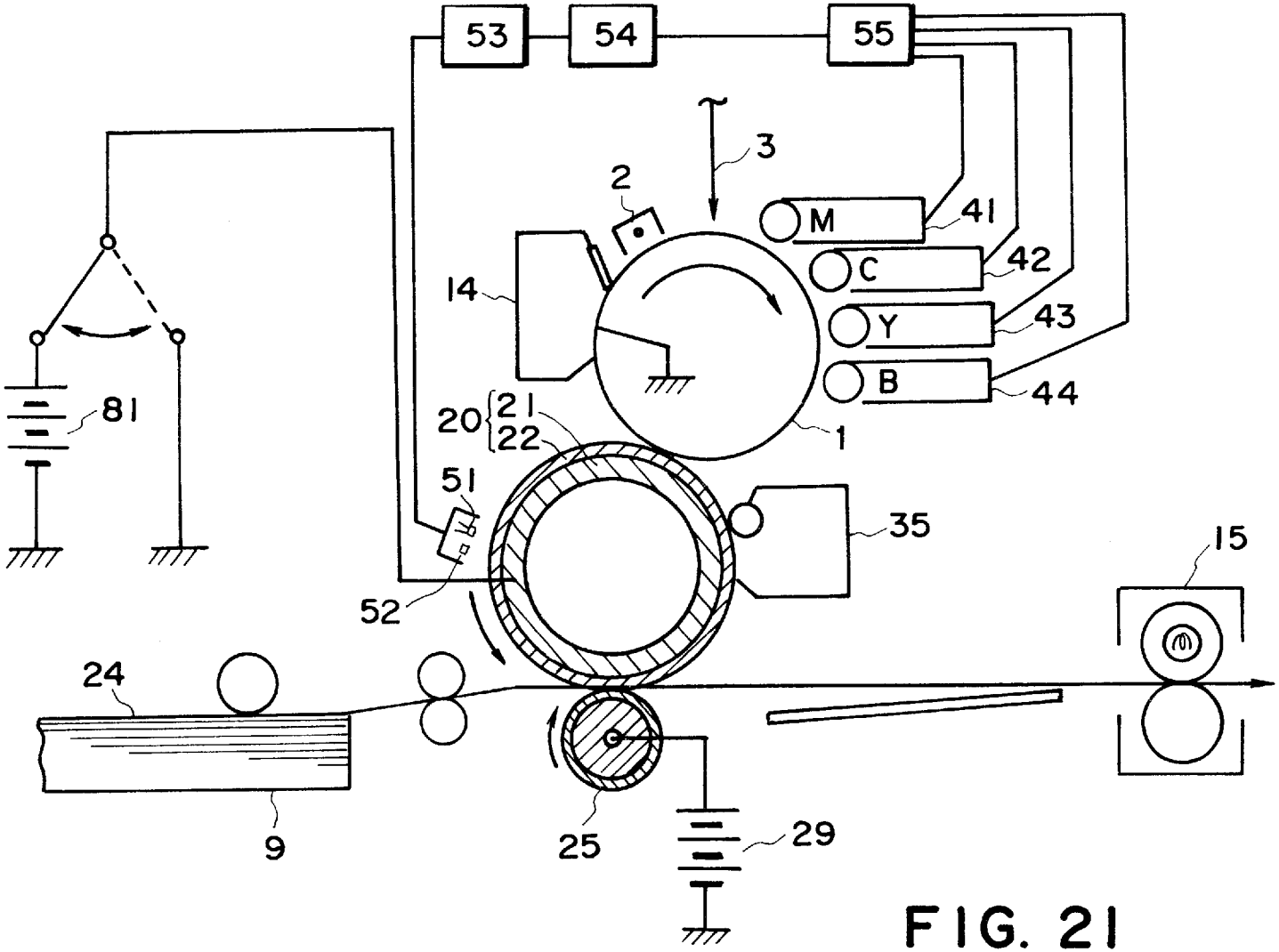
FIGS. 21 and 22 are respective an illustrations of an embodiment of the image forming apparatus according to the invention.

The intermediate transfer member was incorporated in an electrophotographic photosensitive member (shown in FIG. 21) having a structure generally as shown in FIG. 1, and also including a density detection circuit 53 for detecting a density of pattern formed on the intermediate transfer member and a control circuit 54 for controlling the image forming conditions, particularly for controlling a developing bias generating circuit 55 in this example, whereby the pattern formation and the pattern density measurement were performed. The density measurement pattern included a succession of 5 squares at 5 density levels from a maximum density to a minimum density for each of yellow, magenta, cyan and black. The light source 51 for the pattern density measurement was an LED (light emission device) emitting light having a principal wavelength of 950 nm. The density levels of the thus-formed pattern were measured by using a silicon photodiode 52, whereby totally 20 density levels (5 levels for each of the four colors of yellow, magenta, cyan and black) were accurately measured and the measured density levels were satisfactorily used for controlling the developing bias voltages.

EXAMPLE 2

Elastic Layer Compound 100 wt. parts of EPDM, 5 wt. parts of zinc oxide, 5 wt. parts of titanium white (colorant), 150 wt. parts of electroconductive titanium oxide, 10 wt. parts of paraffin oil, 2 wt. parts of sulfur, and totally 4 weight parts of vulcanization promoters (1 wt. part of MBT, 1.5 wt. parts of TMTD and 1.5 wt. parts of ZnMDC) were blended by a two-roll mill under cooling for 20 min to prepare a compound.

Surface Layer Paint 50 wt. parts of polyurethane prepolymer, 20 wt. parts of electroconductive aluminum borate whisker, 5 wt. parts of dispersion aid, 50 wt. parts of curing agent, and 100 wt. parts of PTFE particles, were blended and dispersed for 30 min. in a beads mill to prepare a surface paint.

Preparation and Evaluation of Intermediate Transfer Member

Figure 18:
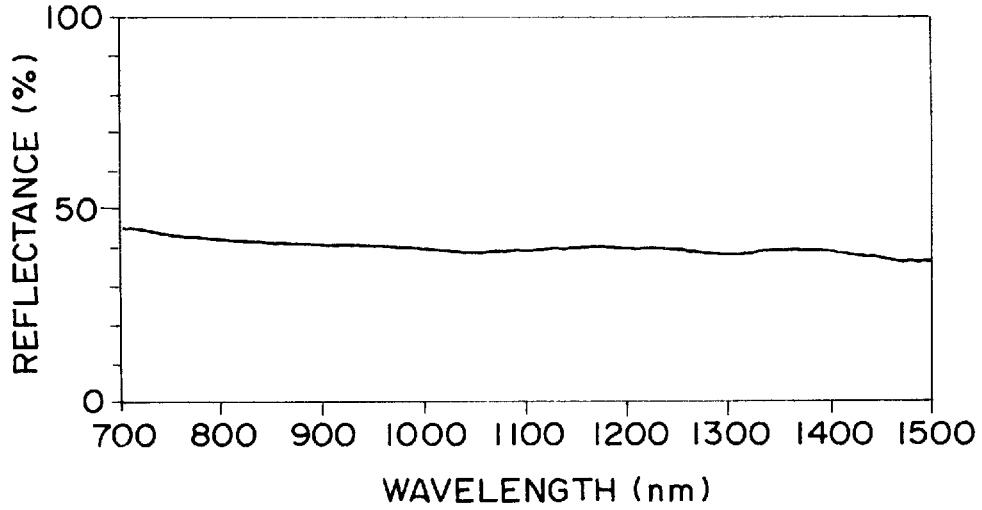

An intermediate transfer member was prepared in the same manner as in Example 1 except for using the above-prepared elastic layer compound and surface layer paint. As a result, the intermediate transfer member showed a spectral reflectance characteristic as shown in FIG. 18.

The intermediate transfer member was incorporated in the same electrophotographic image forming apparatus as in Example 1 and evaluated in the same manner as in Example 1, whereby all the density levels for the respective colors were accurately measured, and the control of the developing biases was satisfactorily performed.

EXAMPLE 3

Elastic Layer Compound 33 wt. parts of SBR, 67 wt. parts of EPDM, 1.5 wt. parts of sulfur, 2 wt. parts of zinc white (vulcanization aid), totally 2.2 wt. parts of vulcanization promoters (1 wt. part of MBT and 1.2 wt. parts of TMTM), 25 wt. parts of electroconductive carbon black, 1 wt. part of stearic acid and 40 wt. parts of plasticizer (naphthene-based process oil), were blended by a two-roll mill under cooling for 20 min. to prepare a compound.

Surface Layer Paint

A surface layer paint was prepared in the same manner as in Example 1 except that the amount of PTFE particles were reduced to 50 wt. parts.

Preparation and Evaluation of Intermediate Transfer Member

The elastic layer compound was vulcanized in a mold at 150° C. for 50 min. to form an endless belt having an outer diameter of 150 mm, a width of 230 mm and a thickness of 0.9 mm. On the outer surface of the endless belt, the above-prepared surface layer paint was applied by spray coating to form a 30 $\mu$m-thick surface layer, thereby obtaining an intermediate transfer member.

As a result of reflectance measurement, the intermediate transfer member showed a reflectance in the range of 10–70% (somewhat lower level than in FIG. 17) in the range of 700–1500 nm.

Figure 22:
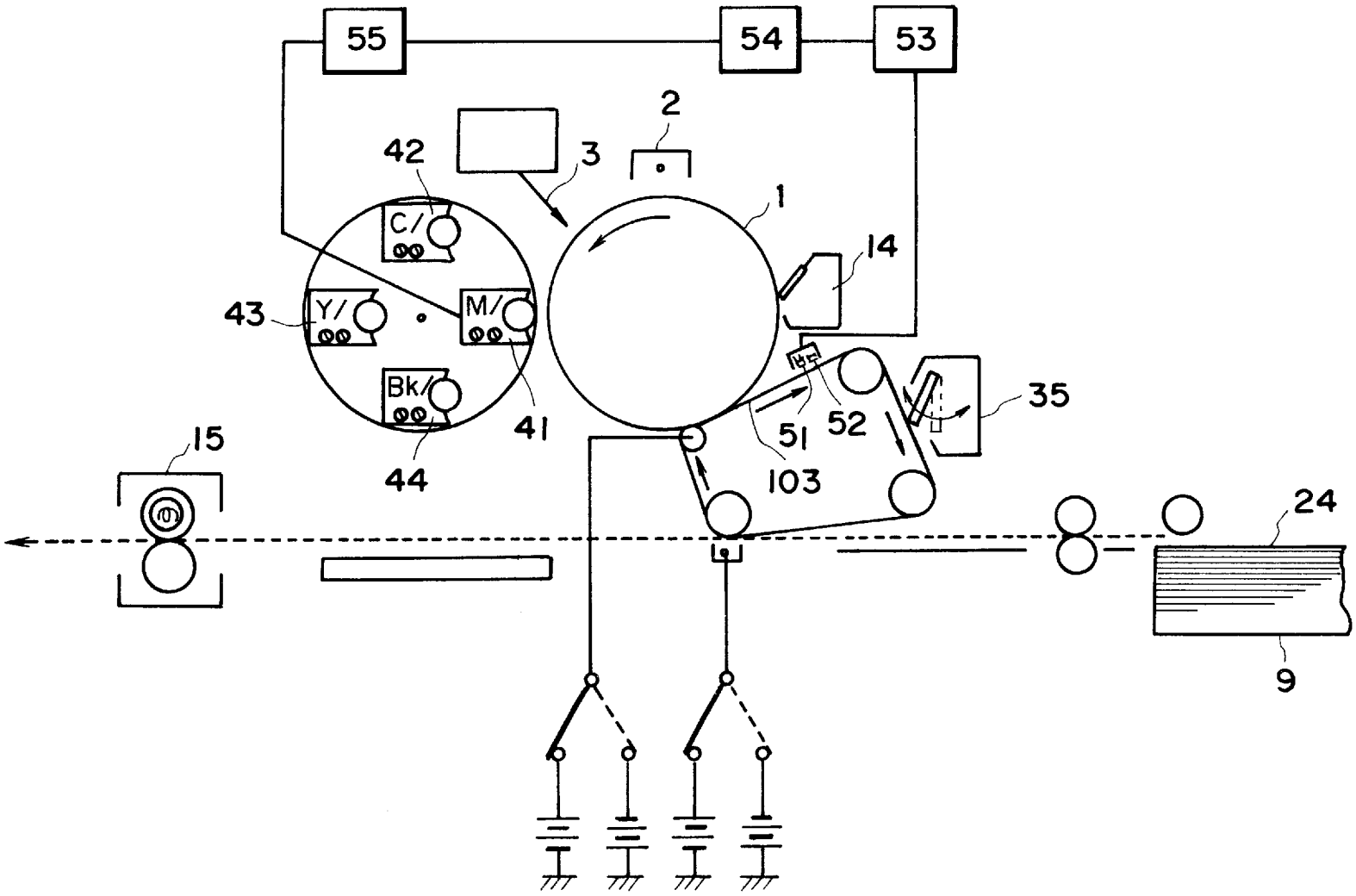

The intermediate transfer member was incorporated in an electrophotographic image forming apparatus shown in FIG. 22 (generally similar to the one shown in FIG. 13 but further including an LED 51, a silicon photodiode 52, a density detection circuit 53, a control circuit 54 and a developing bias supply 55 similar to those used in Example 1), whereby all the density levels for the respective colors were accurately measured, and the control of the developing bias voltages was satisfactorily performed.

COMPARATIVE EXAMPLE 1

Preparation and Evaluation of Intermediate Transfer Member

Figure 19:
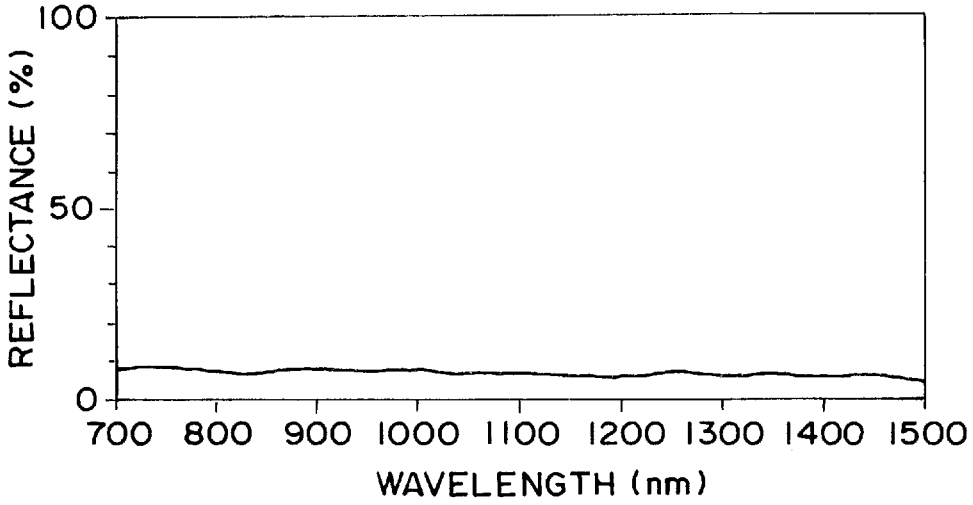

An intermediate transfer member was prepared in the same manner as in Example 1 except that surface layer paint was replaced by the one of Example 2 to form a 25 $\mu$m-thick surface layer. The resultant intermediate transfer member showed a spectral reflectance characteristic as shown in FIG. 19 showing a reflectance of below 10% over the range of 700 nm to 1500 nm.

The intermediate transfer member was incorporated in the same electrophotographic image forming apparatus as in Example 1 and evaluated in the same manner as in Example 1, whereby all the density levels could be measured for yellow, magenta and cyan but the pattern density detection was impossible for black because of too low a spectral reflectance difference.

COMPARATIVE EXAMPLE 2

Elastic Layer Compound

Same as in Example 2.

Surface Layer Paint 50 wt. parts of polyurethane prepolymer, 10 wt. parts of titanium white (colorant), 40 wt. parts of electroconductive titanium oxide, 5 wt. parts of dispersion aid, 100 wt. parts of toluene, 50 wt. parts of curing agent and 100 wt. parts of PTFE particles, were blended and dispersed for 30 min. in a beads mill to prepare a surface layer paint.

Preparation and Evaluation of Intermediate Transfer Member

Figure 20:
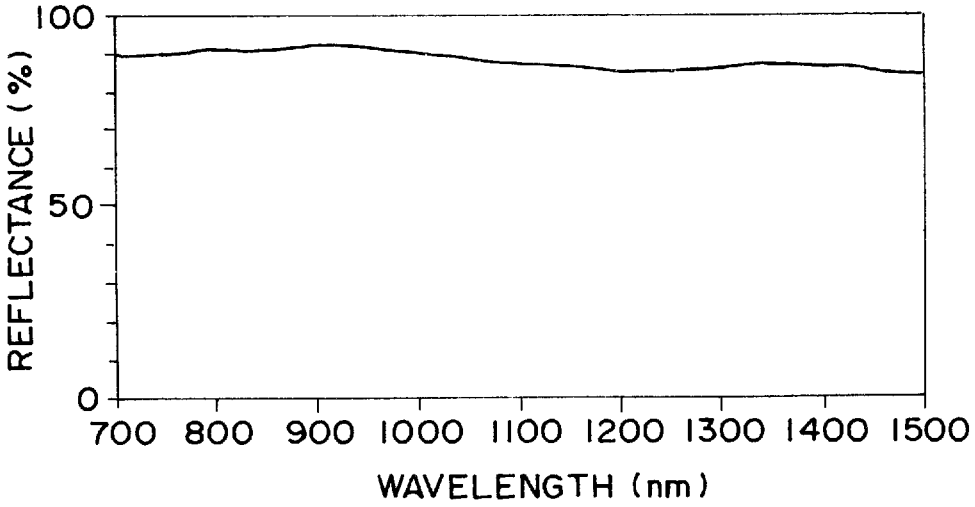

An intermediate transfer member was prepared in the same manner as in Example 1 except that the elastic layer compound and the surface layer paint were replaced by those described above. The resultant intermediate transfer member showed a spectral reflectance characteristic as shown in FIG. 20 showing a reflectance of ca. 80–90% over the range of 700 nm to 1500 nm.

The intermediate transfer member was incorporated in the same electrophotographic image forming apparatus as in Example 1 and evaluated in the same manner as in Example 1, whereby all the density levels could be measured for black but the pattern density detection was impossible for yellow, magenta or cyan because of the excessively high reflectance of the intermediate transfer member.

What is claimed is:

1. An image forming apparatus, comprising:

a first image-bearing member, an intermediate transfer member for receiving an image formed on the first image-bearing member and transferring the image onto a second image-bearing member, pattern-forming means for forming a prescribed pattern on the intermediate transfer member, density detection means for detecting a density of the pattern, and control means for controlling image forming conditions based on the detected density, wherein the intermediate transfer member has a laminated structure including a layer containing a pigment for providing a reflectance of 10–70% for light having a wavelength in the range of 700–1500 nm at least in a region thereof for forming the prescribed pattern.

2. An apparatus according to claim 1, wherein the intermediate transfer member includes an elastic layer and a coating layer thereon, and the elastic layer contains the pigment.

3. An apparatus according to claim 2, wherein the pigment is a white pigment.

4. An apparatus according to claim 3, wherein the pigment comprises titanium white.

5. An apparatus according to claim 1, wherein the pigment is a white pigment.

6. An apparatus according to claim 5, wherein the pigment comprises titanium white.

7. An apparatus according to claim 1, wherein the intermediate transfer member is in the form of a drum.

8. An apparatus according to claim 1, wherein the first image-bearing member comprises an electrophotographic photosensitive member.

9. An image forming apparatus, comprising:

a first image-bearing member;

an intermediate transfer member for receiving an image formed on the first image-bearing member and transferring the image onto a second image-bearing member;

pattern-forming means for forming prescribed patterns with toners in four colors of yellow, magenta, cyan and black on the intermediate transfer member;

density detection means for detecting densities of the patterns by illuminating the intermediate transfer member with light having a principal wavelength in the range of 700–1500 nm and measuring reflected light quantities from the intermediate transfer member; and control means for controlling image forming conditions for images of the four colors, respectively, based on the detected densities, wherein the intermediate transfer member has a laminated structure including a layer containing a pigment for providing a reflectance of 10–70% for the illuminating light at least in a region thereof for forming the prescribed patterns.

10. An apparatus according to claim 9, wherein the intermediate transfer member includes an elastic layer and a coating layer thereon, and the elastic layer contains the pigment.

11. An apparatus according to claim 10, wherein the pigment is a white pigment.

12. An apparatus according to claim 11, wherein the pigment comprises titanium white.

13. An apparatus according to claim 9, wherein the pigment is a white pigment.

14. An apparatus according to claim 13, wherein the pigment comprises titanium white.

15. An apparatus according to claim 9, wherein the intermediate transfer member is in the form of a drum.

16. An apparatus according to claim 9, wherein the first image-bearing member comprises an electrophotographic photosensitive member.

* * * * *

UNITED STATES PATENT AND TRADEMARK OFFICE

CERTIFICATE OF CORRECTION

PATENT NO. : 5,842,080

DATED : November 24, 1998

INVENTOR(S) : TSUNENORI ASHIBE, ET AL.

It is certified that error appears in the above-identified patent and that said Letters Patent is hereby corrected as shown below:

Column 1

Line 10, "an image" should read --to an image--; and
Line 49, "accordance" should read --in accordance--.

Column 2

Line 1, "driven" should read --is driven-- and "driver" should be deleted.

Column 3

Line 7, "envelop." should read --envelope,--;
Line 16, "performance are" should read --performance is--;
Line 34, "generate" should read --generated--; and
Line 45, "in for" should read --for--.

UNITED STATES PATENT AND TRADEMARK OFFICE

CERTIFICATE OF CORRECTION

PATENT NO. : 5,842,080

DATED : November 24, 1998

INVENTOR(S) : TSUNENORI ASHIBE, ET AL.

It is certified that error appears in the above-identified patent and that said Letters Patent is hereby corrected as shown below:

Column 4

Line 22, "(1 X $10^{4-1X}$" should read --(1 X $10^{4}$-1 X--; and
Line 23 "$_{1C}{}^{13}$" should read --$10^{13}$--.

Column 5

Line 28, "respective a" should read --respective--;
Line 40, "characteristic" should read --characteristics--;
Line 43, "respective an" should read --respective--; and
Line 65, "characteristic" should read --characteristics--.

Column 6

Line 38, "average" should read --on average--.

UNITED STATES PATENT AND TRADEMARK OFFICE

CERTIFICATE OF CORRECTION

PATENT NO. : 5,842,080

DATED : November 24, 1998

INVENTOR(S) : TSUNENORI ASHIBE, ET AL.

It is certified that error appears in the above-identified patent and that said Letters Patent is hereby corrected as shown below:

Column 7

Line 55, "1 X $10^{4-1X103}$" should read --1 X $10^4$-1 X $10^3$--.

Column 9

Line 6, "imaged" should read --image--.

Column 10

Line 63, "min" should read --min.--.

Column 14

Line 16, "claim 9," should read --claim 10,--.

Signed and Sealed this

Thirty-first Day of August, 1999

*Attest:*

Q. TODD DICKINSON

*Attesting Officer*

*Acting Commissioner of Patents and Trademarks*